United States Patent [19]

Wakaizumi

[11] Patent Number: 4,762,076

[45] Date of Patent: Aug. 9, 1988

[54] RULER DEVICE FOR SETTING EMBROIDERING FABRIC

[75] Inventor: Kiyoshi Wakaizumi, Tokyo, Japan

[73] Assignee: Janome Sewing Machine Co. Ltd., Tokyo, Japan

[21] Appl. No.: 121,349

[22] Filed: Nov. 16, 1987

[30] Foreign Application Priority Data

Nov. 14, 1986 [JP] Japan ..... 61-173965[U]

[51] Int. Cl.[4] ..... D05C 9/04

[52] U.S. Cl. ..... 112/103; 38/102.2

[58] Field of Search ..... 112/103, 102, 98, 155, 112/121.12, 121.15; 38/102.2; 160/380

[56] References Cited

U.S. PATENT DOCUMENTS

| | | | |
|---|---|---|---|
| 3,664,288 | 5/1972 | Von Boden et al. | 112/103 |
| 4,357,885 | 11/1982 | Stockton | 112/103 |
| 4,411,208 | 10/1983 | Nishida et al. | 112/103 |
| 4,485,574 | 12/1984 | Bennetot | 38/102.2 |
| 4,598,665 | 7/1986 | Takenoya | 112/103 |
| 4,642,924 | 2/1987 | Suddenth et al. | 38/102.2 |

*Primary Examiner*—H. Hampton Hunter

*Attorney, Agent, or Firm*—Michael J. Striker

[57] ABSTRACT

A ruler device for setting a fabric to be stitched on an embroidering frame and held between an outer frame and an inner frame comprises a ruler attached to the inner frame and provided with a gauge having marks corresponding to coordinate directions and provided on the transparent bottom of the ruler.

4 Claims, 1 Drawing Sheet

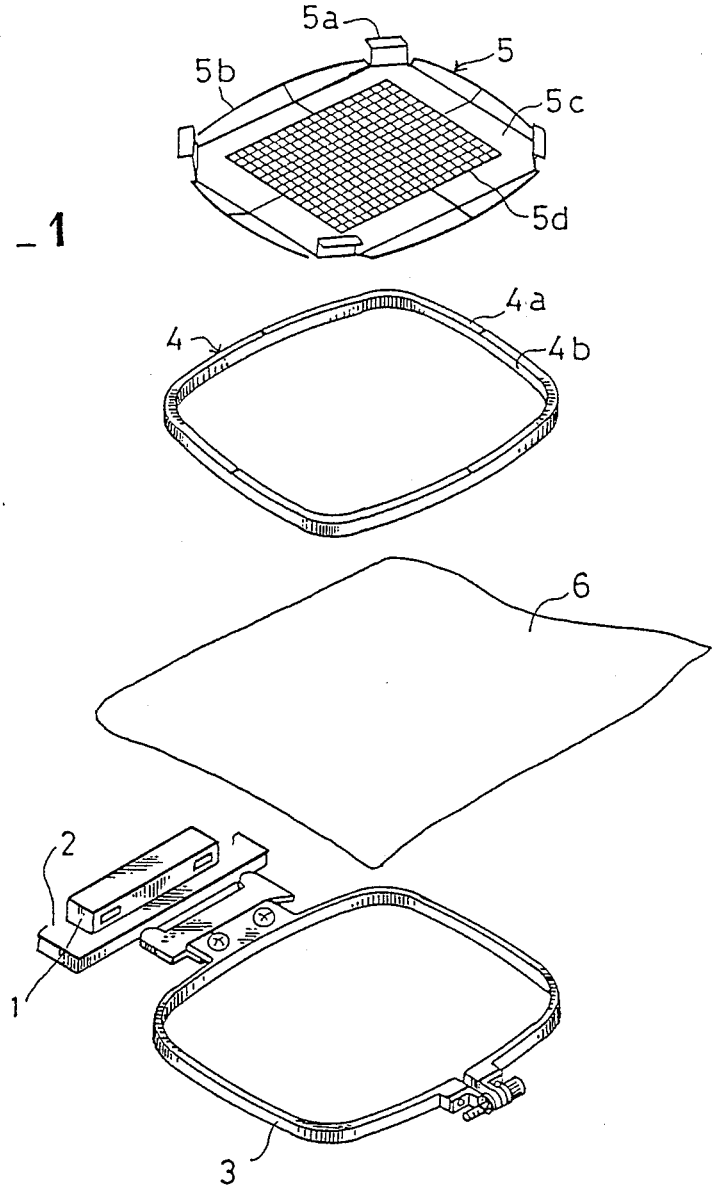
FIG_1
FIG_2
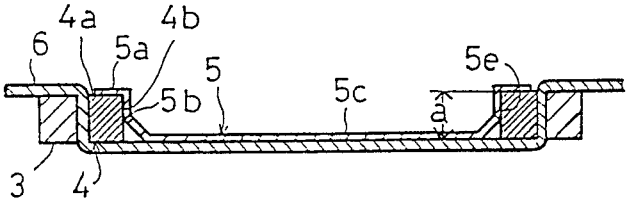
FIG_3
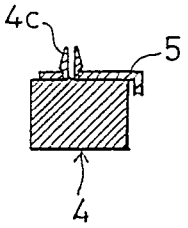

RULER DEVICE FOR SETTING EMBROIDERING FABRIC

FIELD OF THE INVENTION

The present invention relates to a ruler device for setting a fabric to be stitched to an embroidering frame of a sewing machine.

BACKGROUND OF THE INVENTION

In an embroidering sewing machine, a fabric to be stitched is set to an embroidering frame. In general, an embroidering is carried out on a completed fabric product or an already cut one. A position to be embroidered of the fabric is in advance determined, and so it is necessary to set the fabric to the embroidering frame in accordance with coordinate directions for moving the embroidering frame.

The prior art proposed that an embroidering outer frame and an inner frame be positioned and formed with marks so as to make the outer frame correspond to a fabric, and since the inner frame is provided with a large opening for producing patterns at an inner side thereof, it is difficult to make detailed designations to the fabric, and so the opening is used for rough positioning. Therefore, for exact positioning re-attachment is required, or the embroidering outer frame is controllably rotated relative to a moving instrument, and after attaching the fabric to the frame, the embroidering outer frame is controlled in rotation such that the fabric to be expanded on the frame is moved in coordinate directions.

With the prior art arrangement it was difficult to exactly set the fabric to be stitched in the coordinate directions.

SUMMARY OF THE INVENTION

It is an object of this invention to provide a device for setting the fabric so as to solve problems of the prior art.

A proposed device comprises an embroidering outer frame attachable to the moving instrument, an embroidering inner frame having an outer side corresponding to an inner side of the outer frame and a positioning part to be placed at the outer frame, and a fabric setting ruler having a part positioned with respect to the outer embroidering frame and a part attached to the embroidering inner frame, and a gauge corresponding to coordinate directions of the moving instrument, provided on a transparent bottom which comes into contact with a fabric held between the embroidering outer frame and the inner frame.

A fabric setting ruler is positioned on the embroidering inner frame with respect to the embroidering outer frame positioned on a body moving in coordinate directions, and a part or parts to be stitched of the fabric meets a gauge of the fabric setting ruler. The embroidering inner frame is positioned and secured together with the embroidering outer frame, whereby the fabric is positioned by the ruler to the inner frame while the inner frame is positioned to the outer frame. After such positioning, the fabric setting ruler is removed from the embroidering inner frame.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is an exploded perspective view showing the parts of a fabric setting ruler device according to the invention;

FIG. 2 is a cross sectional view through the ruler, illustrating the setting of the embroidering fabric; and FIG. 3 is a sectional view through the fabric setting ruler and the embroidering inner frame according to another embodiment of the invention.

DETAILED DESCRIPTION OF THE PREFERRED EMBODIMENTS

In FIG. 1, reference numeral 1 designates an element for holding an embroidering frame which can be moved in synchronism with a needle (nonshown) which reciprocates vertically, and in the directions of coordinates in respect to the needle. Numeral 3 is an embroidering outer frame which has an attaching part and is positioned by the holding element 1. Numeral 4 is an embroidering inner frame the outer side of which corresponds to the inner side of the outer frame 3 so that a fabric 6 is supported therebetween. The inner side of the outer frame 3 and the outer side of the inner frame 4 have non-circular shapes, so that the inner frame 4 is not moved when it is fitted in the inner side of the outer frame 3.

The numeral 5 is a fabric setting ruler made of a transparent thin plate, which has projections **5*a* for engaging on an upper rim 4*a* and an inner side 4*b* of the inner frame 4 and extending parts 5*b* which are positioned in assembly within the embroidering inner frame 4. A bottom 5*c* of the the setting ruler 5 is lowered by thickness "a" (FIG. 2) of the frame 4 from the projections 5*a*, and is a transprent plain surface on which a gauge 5*d*** is formed.

The gauge **5*d* is provided with marks which correspond to a plurality coordinate directional positions in which the embroidering outer frame 3 moves, when the embroidering inner frame 4 attached to the fabric setting ruler 5 is fitted to the embroidering outer frame 3**.

The mode of operation of the fabric setting ruler of this invention is as follows:

The embroidering outer frame 3 is positioned on the moving element 1. The positioning extending parts **5*b* of the ruler 5 are attached to the inner side 4*b* of the inner frame 4, and lower faces of the engaging projections 5*a* are attached to the upper rim 4*a* of the inner frame 4, while attaching faces 5*e* of the positioning extending parts 5*b* are fitted to the inner side 4*b*, as shown in FIG. 2, and the fabric setting ruler 5 becomes attached to the inner frame 4**.

Fabric 6 to be stitched on is placed to the lower side of the embroidering inner frame 4 assembled with the fabric setting ruler 5, and is led to the gauge **5*d* on the bottom 5*c* of the ruler 5 to correctly position a part of the fabric to be stitched, and the fabric 6 and the inner frame 4 are secured within the outer frame 3. The fabric setting ruler 5 is then removed from the engagement with the inner frame 4**.

The fabric 6 is thereby set between the inner frame 4 and outer frame 3 by the ruler 5, and an embroidering range will be defined around the inner frame 4.

FIG. 2 shows the engagement between the embroidering inner frame 4 and the ruler 5 provided by a spring property of the ruler. Further, it is possible that a portion of the fabric setting ruler 5 be formed with holes as shown in FIG. 3, and corresponding pins 4c be formed at the embroidering inner frame 4. The pins 4c may be formed with slits to give to the pins a spring property, so that the fabric setting ruler would be easily attached to the embroidering inner frame 4 with well satisfied durability.

It will be understood that each of the elements described above, or two or more together, may also find a useful application in other types of ruler devices for setting embroidering fabric differing from the types described above.

While the invention has been illustrated and described as embodied in a fabric setting ruler, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. An embroidering fabric setting ruler device for a sewing machine provided with a stitch forming instrument in association with a vertically reciprocating needle and an instrument moving in coordinate directions in synchronism with the needle, the device comprising an embroidering outer frame attachable to said moving instrument and having an inner side; an embroidering inner frame having an outer side corresponding to the inner side of the outer frame and including a positioning portion to be placed on said outer frame, said fabric being held between the embroidering outer frame and the embroidering inner frame; and a fabric setting ruler having positioning means placed on the embroidering inner frame for attaching to said embroidering inner frame, and gauge means formed in correspondence to coordinate directions of said moving instrument, said ruler including a transparent bottom which in assembly comes into contact with the fabric held between the embroidering outer frame and the embroidering inner frame, said gauge means being positioned on said transparent bottom, whereby the fabric being held can be easily set in coordinate directions in accordance with said gauge means.

2. The ruler device as defined in claim 1, wherein said positioning means include projections outwardly extending from said setting ruler and abutting said inner frame in assembly.

3. The ruler device as defined in claim 1, wherein said gauge means includes a plurality of marks formed in accordance with said coordinate directions.

4. The ruler device as defined in claim 1, wherein said setting ruler is removable from said inner frame.

* * * * *